US009096059B2

(12) United States Patent
Hatsui et al.

(10) Patent No.: US 9,096,059 B2
(45) Date of Patent: Aug. 4, 2015

(54) SUBSTRATE FOR INKJET HEAD, INKJET HEAD, AND INKJET PRINTING APPARATUS

(71) Applicant: CANON KABUSHIKI KAISHA, Tokyo (JP)

(72) Inventors: Takuya Hatsui, Tokyo (JP); Yuzuru Ishida, Yokohama (JP); Kazuaki Shibata, Oita (JP); Takeru Yasuda, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/138,287

(22) Filed: Dec. 23, 2013

(65) Prior Publication Data

US 2014/0184703 A1 Jul. 3, 2014

(30) Foreign Application Priority Data

Dec. 27, 2012 (JP) ..... 2012-285437
Dec. 27, 2012 (JP) ..... 2012-285449

(51) Int. Cl.
*B41J 2/05* (2006.01)
*B41J 2/14* (2006.01)

(52) U.S. Cl.
CPC ..... *B41J 2/14129* (2013.01); *B41J 2/14112* (2013.01)

(58) Field of Classification Search
CPC ..... B41J 2/1412; B41J 2/14112
See application file for complete search history.

(56) References Cited

U.S. PATENT DOCUMENTS 4,777,494 A 10/1988 Shibata et al.
6,231,166 B1 5/2001 Kawai et al.
6,361,150 B1 3/2002 Schulte et al.
6,512,284 B2 * 1/2003 Schulte et al. ..... 257/530
7,374,275 B2 5/2008 Shibata et al.
7,566,116 B2 7/2009 Saito et al.
7,862,155 B2 1/2011 Shibata et al.
7,896,476 B2 3/2011 Kubo et al.

(Continued)

FOREIGN PATENT DOCUMENTS

EP 0636478 A2 2/1995
EP 1080897 A2 3/2001

(Continued)

OTHER PUBLICATIONS

U.S. Appl. No. 14/138,295, filed Dec. 23, 2013.

(Continued)

*Primary Examiner* — Geoffrey Mruk
(74) *Attorney, Agent, or Firm* — Fitzpatrick, Cella, Harper & Scinto

(57) ABSTRACT

There are provided a substrate for an inkjet head, an inkjet head, and an inkjet printing apparatus wherein in a case where current is carried through a protection layer for heating resistors, electrical connection to its periphery is prevented without fail. The substrate for the inkjet head includes a first protection layer disposed to cover a heating resistor layer and having an insulation property and a second protection layer disposed to contact the first protection layer and having conductivity. The second protection layer includes a plurality of individual sections provided to correspond to the plurality of heating resistors, a common section connecting the plurality of individual sections, and fuse sections connecting the individual sections and the common section, the fuse sections being formed to be thinner than the individual sections.

10 Claims, 14 Drawing Sheets

(56) References Cited

U.S. PATENT DOCUMENTS

| | | | |
|---|---|---|---|
| 7,954,238 | B2 | 6/2011 | Shibata et al. |
| 8,070,267 | B2 | 12/2011 | Takeuchi et al. |
| 8,075,102 | B2 | 12/2011 | Hatsui et al. |
| 8,129,204 | B2 | 3/2012 | Saito et al. |
| 2004/0017420 | A1 | 1/2004 | Miyamoto et al. |
| 2005/0057611 | A1 | 3/2005 | Miyamoto et al. |
| 2009/0315954 | A1 | 12/2009 | Sakurai et al. |
| 2010/0079551 | A1 | 4/2010 | Saito et al. |
| 2012/0105537 | A1 | 5/2012 | Sakai et al. |

FOREIGN PATENT DOCUMENTS

| | | | |
|---|---|---|---|
| EP | 1352744 | A2 | 10/2003 |
| JP | 3828728 | B2 | 7/2006 |

OTHER PUBLICATIONS

U.S. Appl. No. 14/138,344, filed Dec. 23, 2013.

Extended European Search Report for EP application No. 13005720.1 issued Mar. 18, 2014 (6 pages).

* cited by examiner

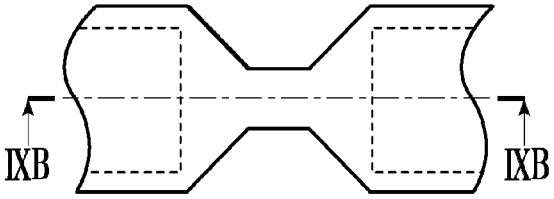
FIG.9A
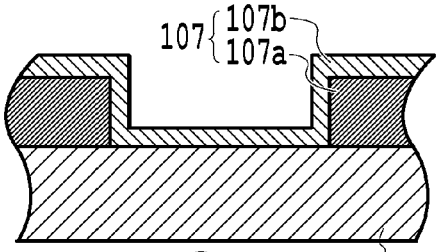
FIG.9B
FIG.9C
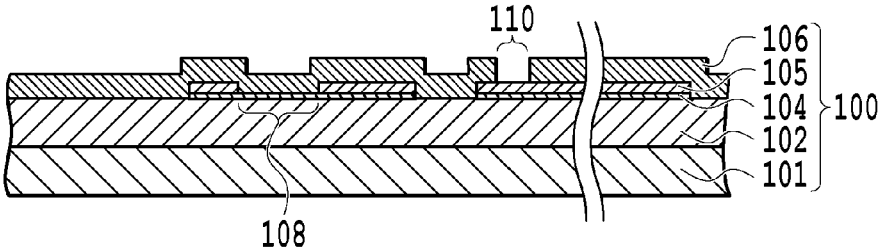
FIG.9D
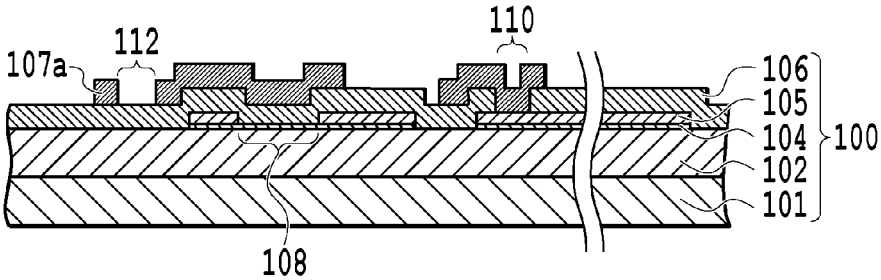
FIG.9E
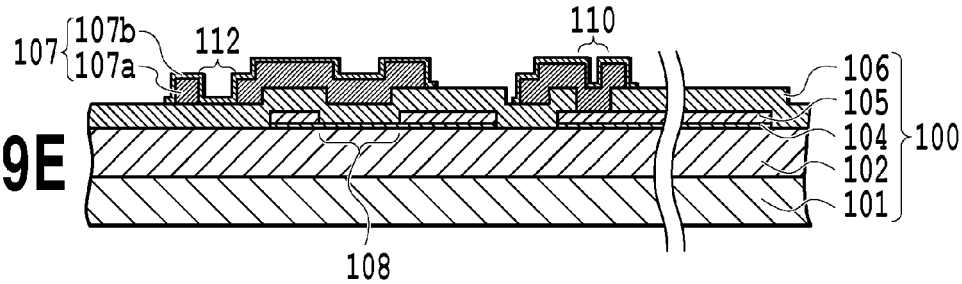
FIG.9F
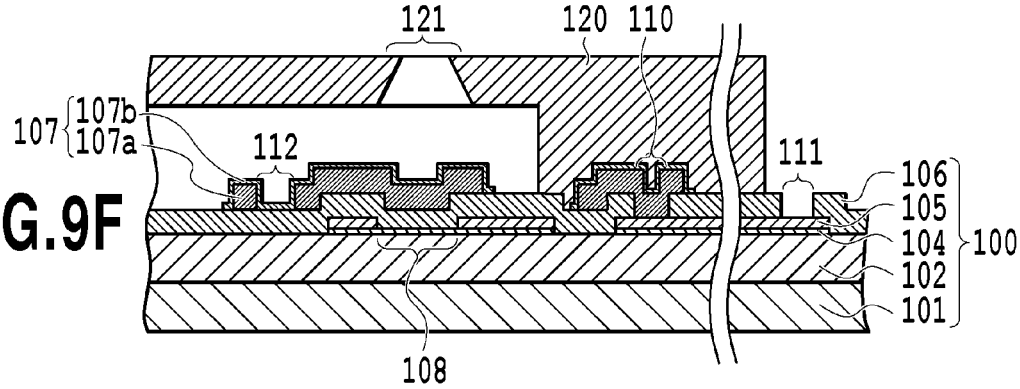

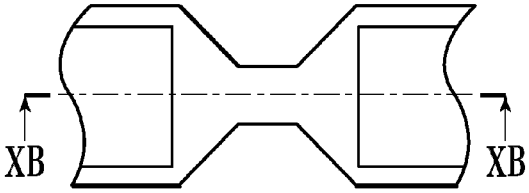
FIG.10A
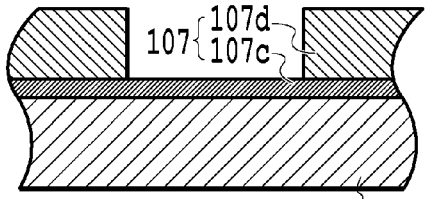
FIG.10B
FIG.10C
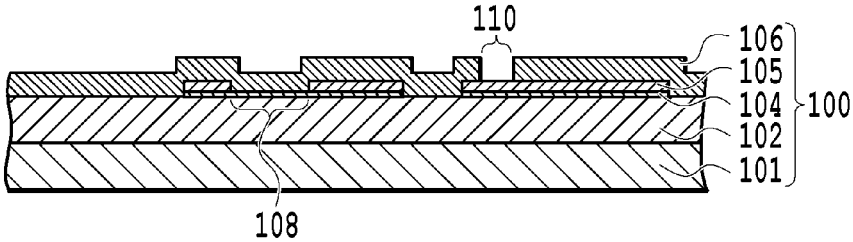
FIG.10D
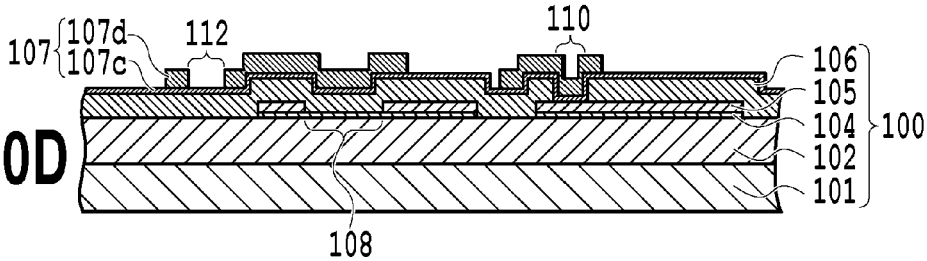
FIG.10E
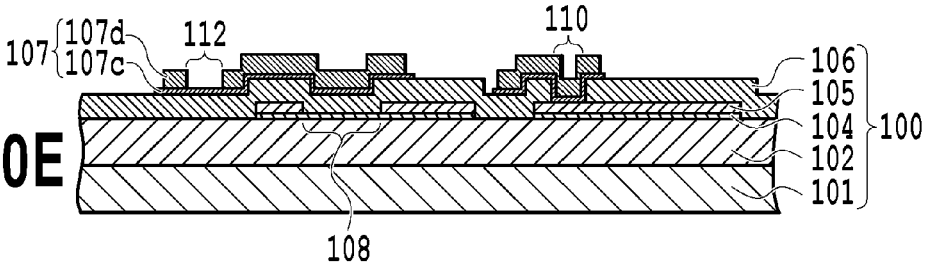
FIG.10F
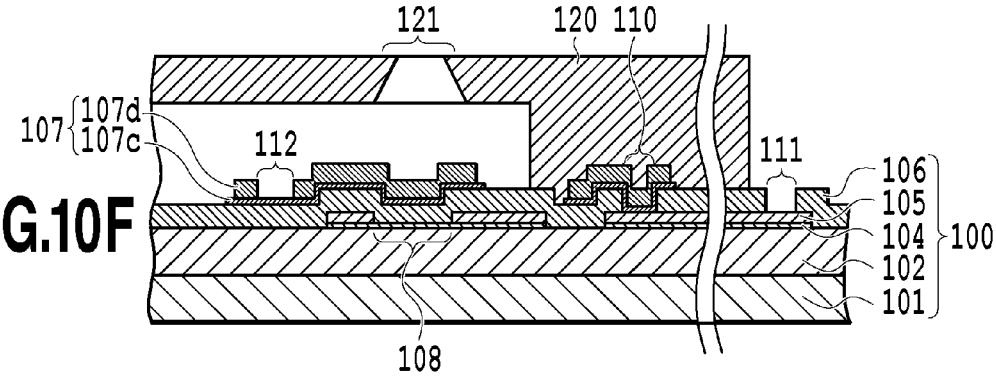

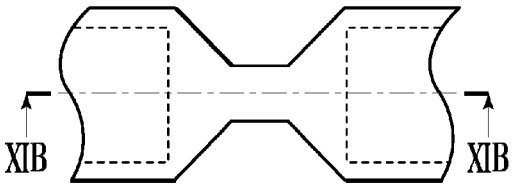
FIG.11A
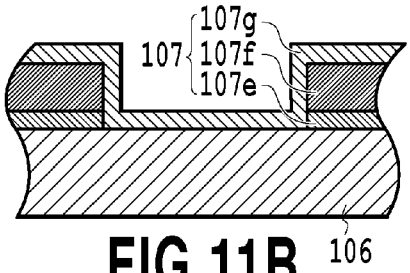
FIG.11B
FIG.11C
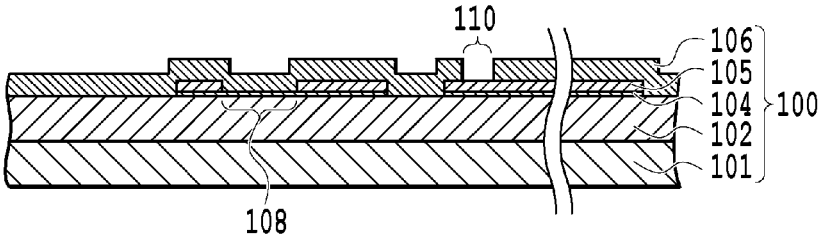
FIG.11D
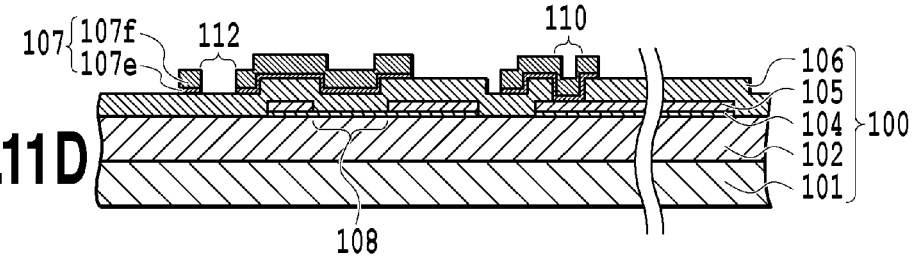
FIG.11E
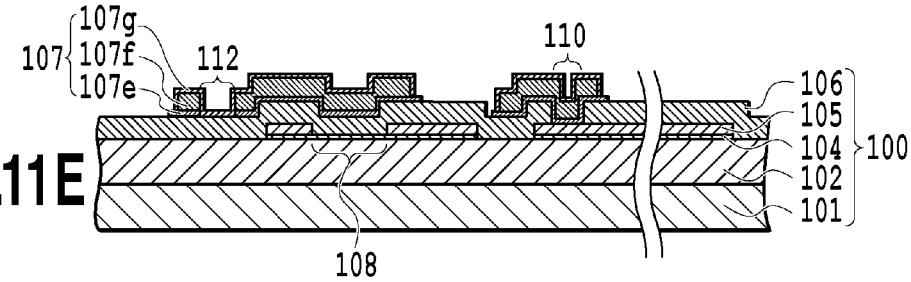
FIG.11F
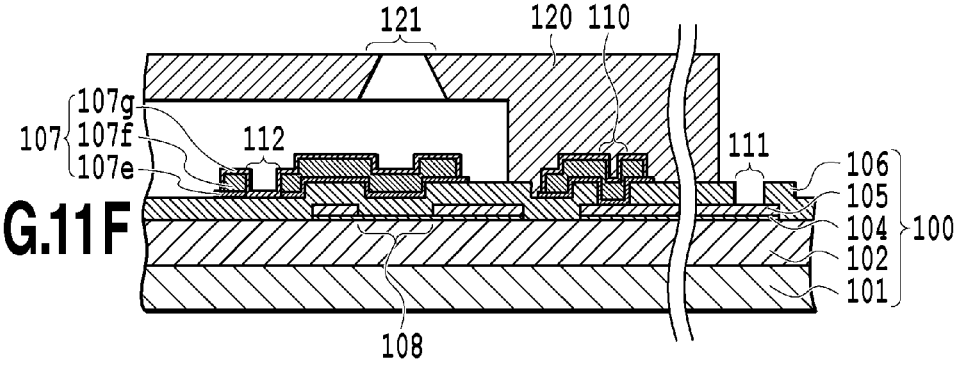

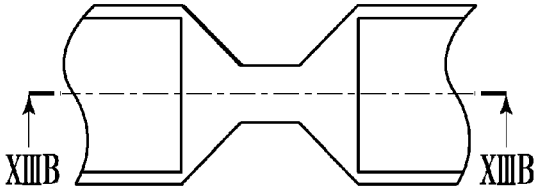
FIG.13A
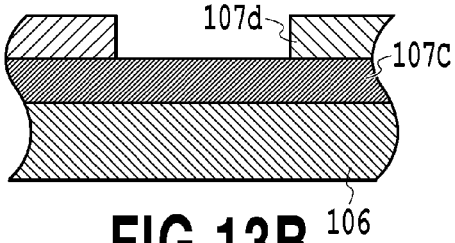
FIG.13B
FIG.13C
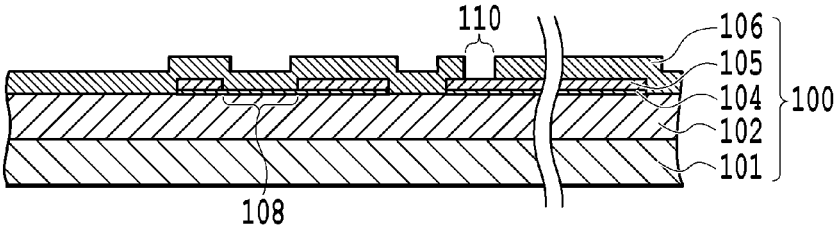
FIG.13D
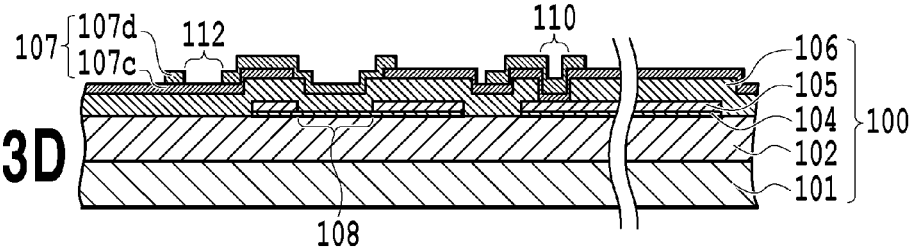
FIG.13E
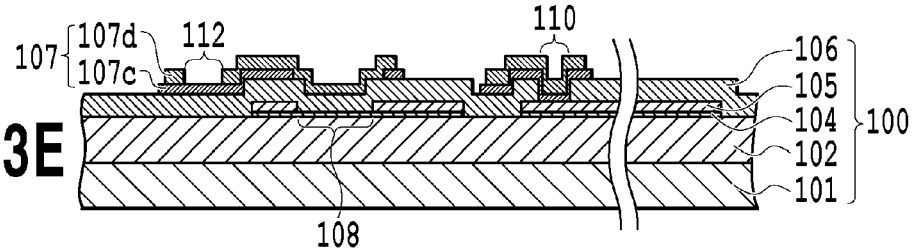
FIG.13F
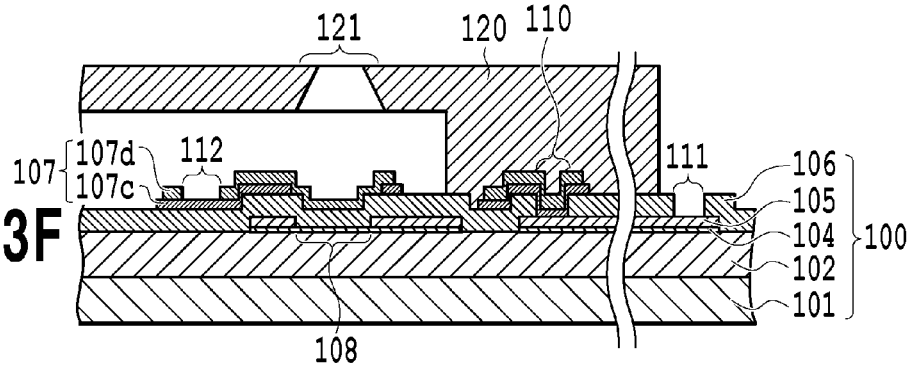

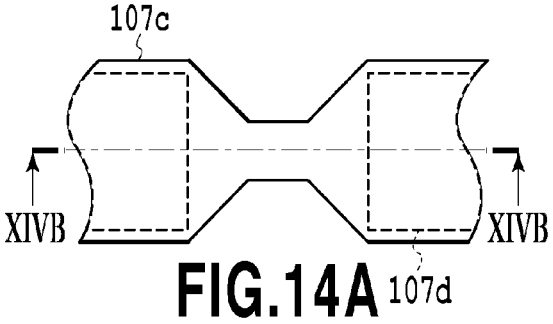
FIG.14A
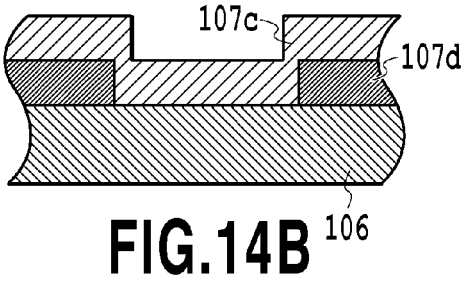
FIG.14B
FIG.14C
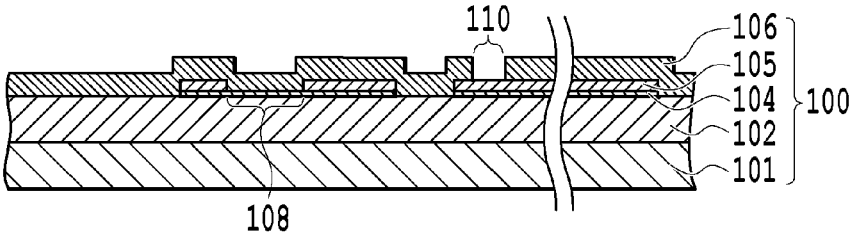
FIG.14D
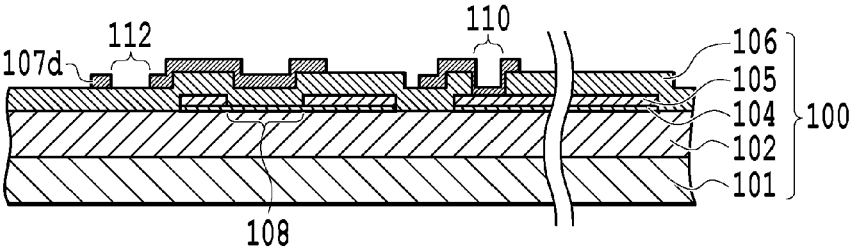
FIG.14E
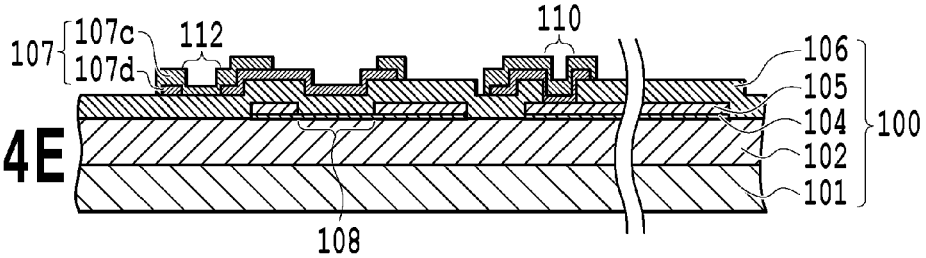
FIG.14F
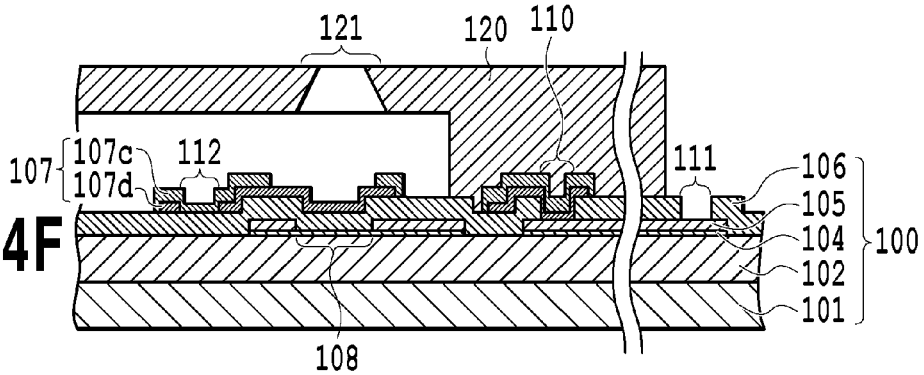

SUBSTRATE FOR INKJET HEAD, INKJET HEAD, AND INKJET PRINTING APPARATUS

BACKGROUND OF THE INVENTION

1. Field of the Invention

The present invention relates to a substrate for an inkjet head, an inkjet head, and an inkjet printing apparatus, and particularly relates to a substrate for an inkjet head, an inkjet head, and an inkjet printing apparatus wherein the insulation property of a protection layer is checked.

2. Description of the Related Art

An inkjet printing apparatus needs to continue to eject as large an amount of ink as possible with one heating resistor. However, heating resistors are occasionally subjected to physical action such as the impact of cavitation caused by ink foaming, shrinkage, and defoaming. Further, in a case where ink reaches the heating resistors, the heating resistors are occasionally subjected to chemical action of the ink.

There is a case where in order to protect the heating resistors from the above physical and chemical actions, a protection layer for protecting the heating resistors is provided. This protection layer is formed on or above the heating resistors, and needs to be made of a material having high heat resistance. Actually, the protection layer is formed with a metal film of Ta (tantalum), a platinum group element Ir (iridium) or Ru (ruthenium), or the like satisfying the above conditions.

The protection layer is normally in contact with ink. Accordingly, the protection layer is in a severe environment in which the temperature of the protection layer rises instantly because of the action of the heating resistors. In a case where electricity flows through the protection layer in this environment, an electrochemical reaction occurs between the protection layer and the ink and the entire protection layer is anodized or eluted. In a case where this phenomenon spreads, the protection film cannot play the original role and the other heating resistors are also ruptured soon.

There is a case where in order to prevent this, an insulating layer is provided between the heating resistors and the protection layer so that part of electricity supplied to the heating resistors does not flow through the protection layer. However, in a case where the electrically insulating protection film (insulating film) is defective at the time of manufacturing, there is a possibility that a short circuit will occur in a heating resistor layer, an electrode wiring layer, and the protection layer.

Accordingly, there is known a technique of connecting separate sections of an upper protection film via fuses each of which is blown in a case where the corresponding heating resistor is damaged (see, for example, Japanese Patent No. 3828728).

Incidentally, the upper protection film needs to play two roles. One role is to protect the heating resistors from the physical action and the chemical action, and this role is the original role of the upper protection film. In order to play this role, the upper protection film needs to have a certain level of thickness.

The other role is to form fuses as the upper protection film and in a case where one of the heating resistors is damaged, blow the corresponding fuse. The upper protection film is formed with high-melting-point metal and large energy is necessary to blow the fuse. Accordingly, it is desirable that the upper protection film be as thin as possible. In other words, the two roles have contradictory requirements for a film thickness.

In view of this, it is conceivable to provide individual through holes and form fuses in another wiring layer. However, since provision of the individual through holes requires space therefor, the density of arranged heating resistors becomes low and the area of a substrate for an inkjet print head becomes large.

SUMMARY OF THE INVENTION

In view of the above, the present invention is made. An object of the present invention is to provide a substrate for an inkjet head, an inkjet head, and an inkjet printing apparatus having a long life and using fuses, wherein even if one heating resistor is ruptured, the other heating resistors are not affected.

According to the present invention, a substrate for an inkjet head comprising: a base; a heating resistor layer disposed on the base and including a plurality of heating resistors which generate heat to eject ink; a first protection layer disposed to cover the heating resistor layer and having an insulation property; and a second protection layer disposed to contact the first protection layer and having conductivity, wherein the second protection layer includes a plurality of individual sections provided to correspond to the plurality of heating resistors, a common section connecting the plurality of individual sections, and fuse sections connecting the individual sections and the common section, the fuse sections being formed to be thinner than the individual sections.

According to the present invention, an inkjet head comprising: the substrate for the inkjet head as described above; and a flow path forming member attached to a side of the substrate on which the second protection layer is disposed and having a plurality of ejection ports formed therein.

According to the present invention, an inkjet printing apparatus for printing onto a print medium with an inkjet head comprising the substrate for the inkjet head as described above and a flow path forming member attached to a side of the substrate on which the second protection layer is disposed and having a plurality of ejection ports formed therein, wherein the external electrode is grounded through the inkjet printing apparatus.

According to the above features, sections of the upper protection film covering the heating resistors are formed to be thick to achieve a long life, and the fuse sections are formed to be thin. As a result, even if one of the heating resistors is damaged and a short circuit occurs in the heating resistor layer and the upper protection film, it is possible to blow the corresponding fuse section instantly.

Further features of the present invention will become apparent from the following description of exemplary embodiments (with reference to the attached drawings).

BRIEF DESCRIPTION OF THE DRAWINGS

FIGS. 9A to 9F are explanatory views schematically illustrating a method for manufacturing a fuse section and an inkjet head of a second embodiment;

FIGS. 10A to 10F are schematic views illustrating a method for manufacturing a fuse section and an inkjet head of a third embodiment;

FIGS. 11A to 11F are schematic views illustrating a method for manufacturing a fuse section and an inkjet head of a fourth embodiment;

FIGS. 13A to 13F are schematic views illustrating a method for manufacturing a fuse section and an inkjet head of a sixth embodiment; and FIGS. 14A to 14F are schematic views illustrating a method for manufacturing a fuse section and an inkjet head of a seventh embodiment.

DESCRIPTION OF THE EMBODIMENTS

Embodiments of the present invention will be described in detail below with reference to the drawings.

First Embodiment

Figure 1:
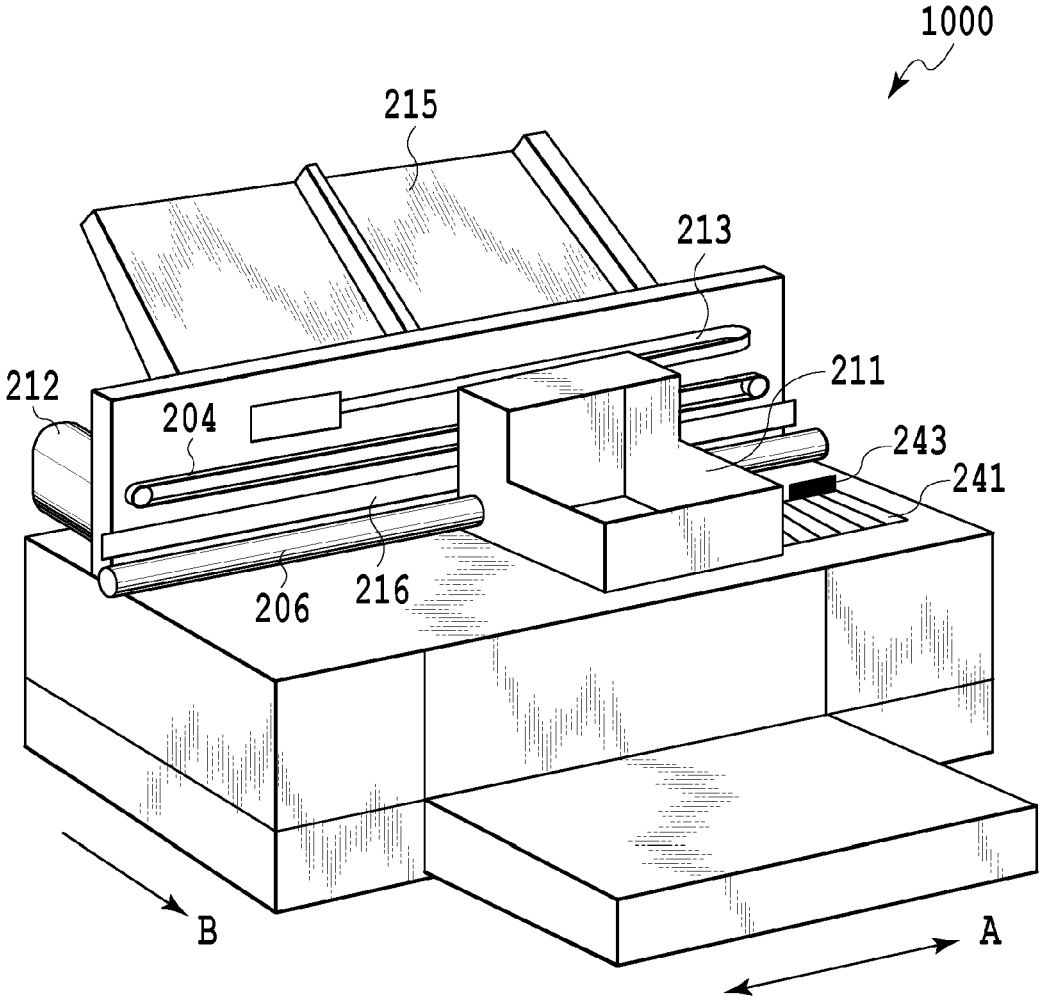
FIG. 1 is a perspective view showing an inkjet printing apparatus of a first embodiment.

FIG. 1 is a perspective view showing an inkjet printing apparatus of the present embodiment. The inkjet printing apparatus 1000 includes a carriage 211 for accommodating therein an inkjet print head unit 410. In the inkjet printing apparatus 1000 of the present embodiment, the carriage 211 is guided along a guide shaft 206 so that the carriage 211 can move in a main scan direction shown by an arrow A. The guide shaft 206 is disposed to extend in a width direction of a print medium. Accordingly, an inkjet print head mounted in the carriage 211 performs printing while performing a scan in a direction crossing a conveyance direction in which the print medium is conveyed. As described above, the inkjet printing apparatus 1000 is a so-called serial-scan type inkjet printing apparatus which prints an image by moving the print head 1 in the main scan direction and conveying the print medium in a sub-scan direction.

The carriage 211 is penetrated and supported by the guide shaft 206 to perform scanning in a direction perpendicular to the conveyance direction of the print medium. A belt 204 is attached to the carriage 211, and a carriage motor 212 is attached to the belt 204. Accordingly, since the driving force of the carriage motor 212 is transmitted to the carriage 211 via the belt 204, the carriage 211 is guided by the guide shaft 206 so that the carriage 211 can move in the main scan direction.

A flexible cable 213 for transferring an electrical signal from a control unit which will be described later to the inkjet print head of the inkjet print head unit is attached to the carriage 211 so that the flexible cable 213 is connected to the inkjet print head unit. Further, the inkjet printing apparatus 1000 includes a cap 241 and a wiper blade 243 which are used to perform a recovery operation for the inkjet print head. Further, the inkjet printing apparatus 1000 has a sheet feeding section 215 for storing print media in a stacked state and an encoder sensor 216 for optically reading the position of the carriage 211.

The carriage 211 is reciprocated in the main scan direction by the carriage motor and a driving force transmission mechanism such as a belt for transmitting the driving force of the carriage motor. The inkjet print head unit 410 is mounted in the carriage 211. The plurality of inkjet print head units 410 corresponding to the types of inks which can be ejected from the inkjet printing apparatus are mounted in the carriage 211. Print media are stacked in the sheet feeding section 215 and thereafter are conveyed by conveyance rollers in the sub-scan direction shown by an arrow B.

Figure 2:
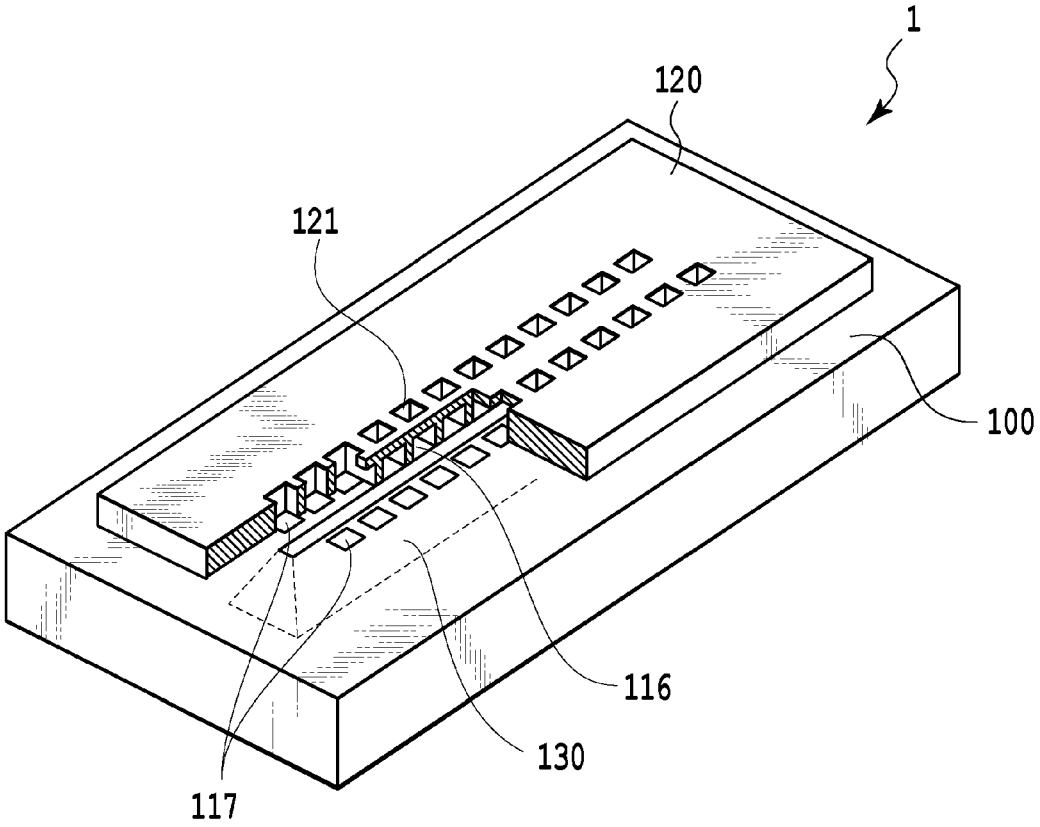
FIG. 2 is a perspective view schematically showing an inkjet head of the first embodiment.

FIG. 2 is a perspective view schematically showing the inkjet head of the present embodiment. The inkjet head 1 of the present embodiment is formed by attaching a flow path forming member 120 to a substrate 100 for the inkjet print head. In the flow path forming member 120, a plurality of ejection ports 121 for ejecting ink are formed at positions where the ejection ports face heat action sections 117 for heating ink. Flow paths 116 extend from an ink supply port 130 penetrating the substrate 100 and communicate with the ink ejection ports 121 through the heat action sections 117. Liquid chambers 131 capable of storing ink in the inkjet head are formed between the flow path forming member 120 and the substrate 100 for the inkjet print head. Further, in each liquid chamber 131, the heat action section 117 is formed (see FIG. 4B).

Figure 3:
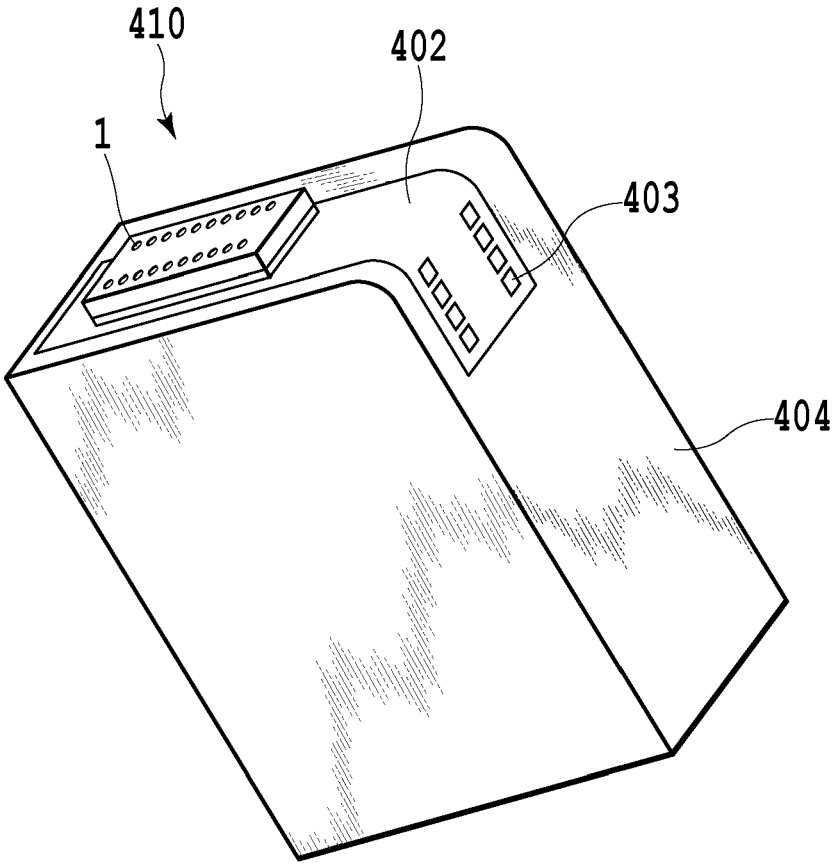
FIG. 3 is a perspective view schematically showing an inkjet head unit of the first embodiment.

FIG. 3 is a perspective view schematically showing the inkjet head unit of the present embodiment. The inkjet head unit 410 of the present embodiment includes the inkjet head 1 and an ink tank 404 and is in the form of a cartridge which can be mounted in the printing apparatus. A tape member 402 for Tape Automated Bonding (TAB) having a terminal for supplying power to the inkjet head 1 supplies power from a printer body via contacts 403. The ink tank 404 stores ink and supplies the ink to the inkjet head 1.

Power is selectively supplied from the inkjet printing apparatus to heating resistors 108 corresponding to the heat action sections 117 through the contacts 403 and the tape member 402.

Incidentally, the inkjet head 1 of the present invention is not limited to a form in which the inkjet head is integral with the ink tank as in the present embodiment. For example, the inkjet head may be in a form that an ink tank is removably mounted and that in a case where the remaining amount of ink in the ink tank reaches zero, the ink tank is demounted and a new ink tank is mounted. Further, the inkjet head may be in a form that the inkjet head is separate from the ink tank and that ink is supplied via a tube or the like. Further, the inkjet head is not limited to the one applied to a serial printing type which will be described below, but may be an inkjet head having ejection ports across the entire width of a print medium like the one applied to a line printer.

Figure 4A:
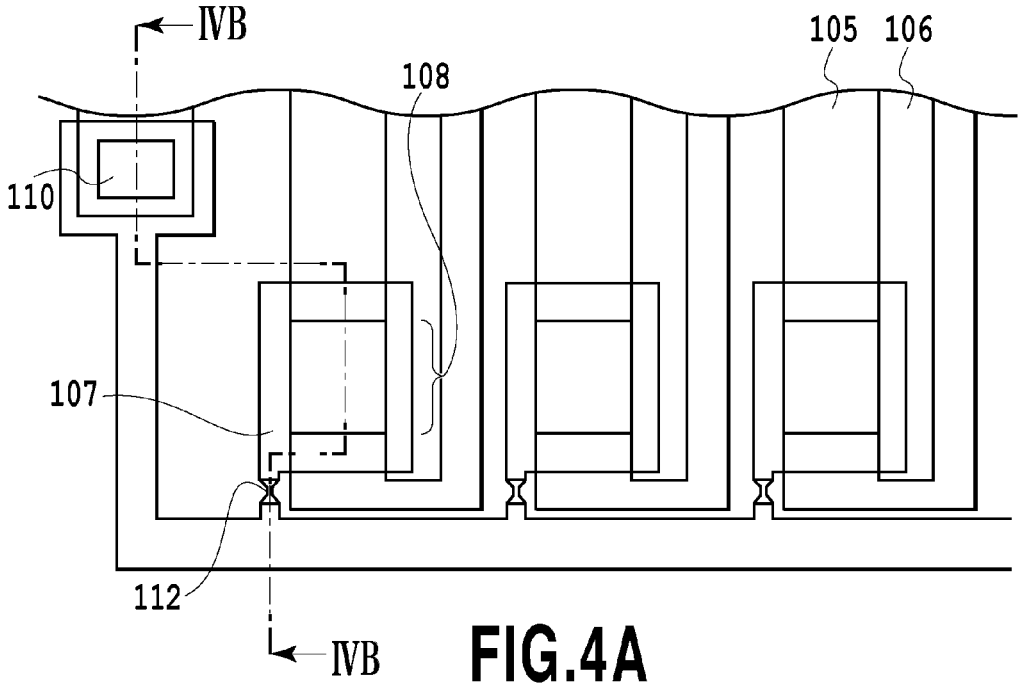
FIGS. 4A and 4B are schematic views showing a portion around a heating section of a substrate for the inkjet head of the first embodiment.
Figure 4B:
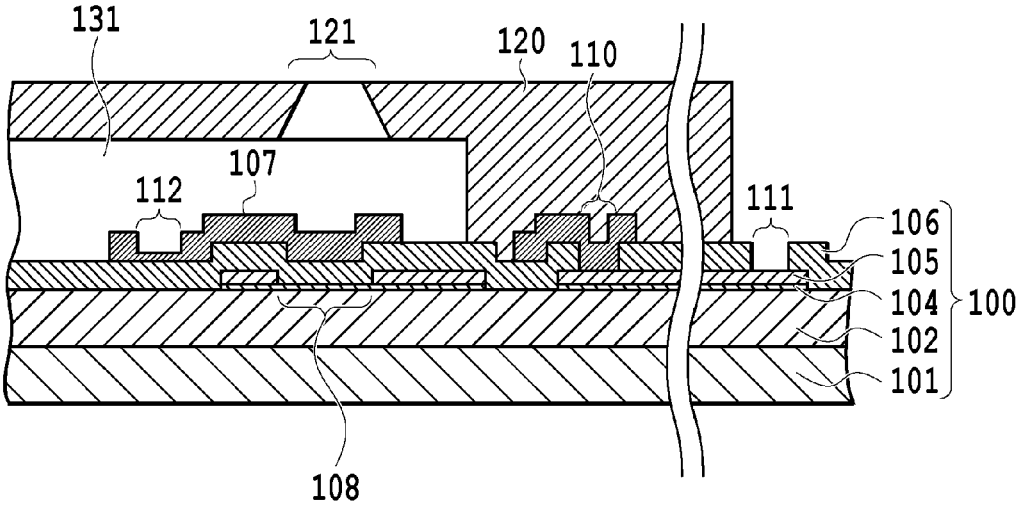

FIGS. 4A and 4B are schematic views showing a portion near a heating section of the substrate for the inkjet head of the present embodiment. FIG. 4A is a schematic plan view showing the substrate for the inkjet head and FIG. 4B is a schematic cross-sectional view showing a state in which the substrate is cut along line IVB-IVB of FIG. 4A.

The substrate for the inkjet head includes a base 101 made of silicon, a heat accumulating layer 102 made of a thermally-oxidized film, a SiO film, a SiN film or the like, a heating resistor layer 104, and an electrode wiring layer 105 as wiring made of a metal material such as Al, Al—Si, or Al—Cu. The heating resistors 108 as electrothermal transducing elements are formed by removing part of the electrode wiring layer 105 to form gaps and exposing corresponding portions of the heating resistor layer 104. The electrode wiring layer 105 is connected to a driving element circuit and an external power supply terminal which are not shown in the drawings and can receive power from the outside.

In the present embodiment, the electrode wiring layer 105 is disposed on the heating resistor layer 104, but it is possible to form the electrode wiring layer 105 on the base 101 or the thermally-oxidized film 102, remove part of the electrode wiring layer 105 to form gaps, and form the heating resistor layer.

A protection layer (first protection layer) 106 which functions also as an insulating layer made of a SiO film, a SiN film, or the like is provided as an upper layer on the heating resistors 108 and the electrode wiring layer 105. An upper protection film (second protection layer) 107 protects the electrothermal transducing elements from the chemical action and the physical impact caused by heat of the heating resistors 108, and in the present embodiment, the upper protection film 107 is formed with Ta or a platinum group element such as Ir or Ru which has high chemical resistance.

The upper protection film 107 includes sections which are individually formed above the heating resistors 108 and a common section connecting the individually formed sections. A fuse section 112 is formed as a connection section between each individual section and the common section. The fuse section of the present embodiment is formed of a single layer.

Figure 5A:
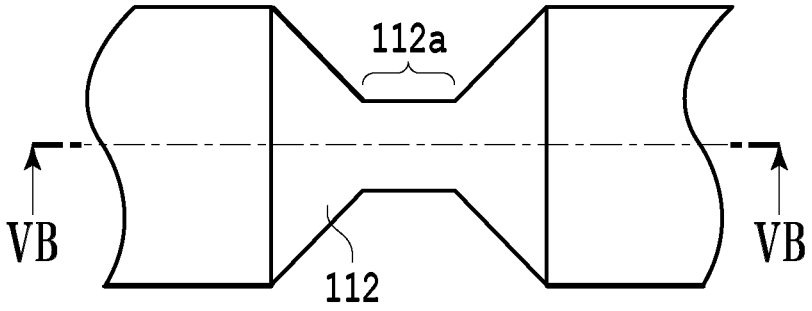
FIGS. 5A and 5B are schematic views showing a fuse section of the first embodiment.
Figure 5B:
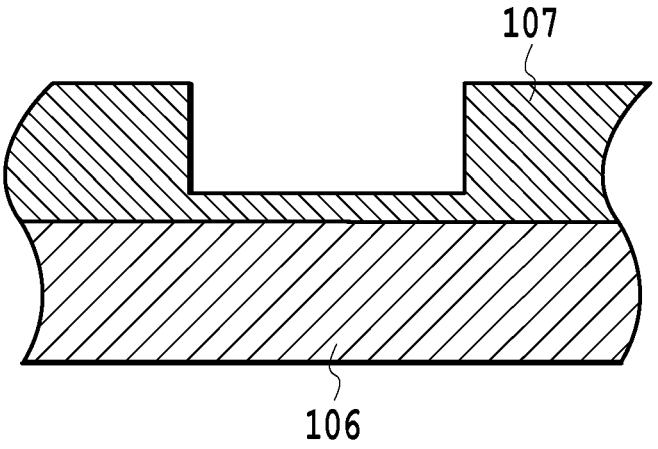

FIGS. 5A and 5B are schematic views showing the fuse section of the present embodiment. FIG. 5A is a plan view showing the fuse section 112, and FIG. 5B is a cross-sectional view showing a state in which the substrate is cut perpendicularly along line VB-VB of FIG. 5A.

A portion 112*a* is a portion to be blown of the fuse section 112. As shown in FIGS. 5A and 5B, the upper protection film 107 above the heating resistors 108 is formed to be thick and has a thickness of about 200 to about 500 nm to achieve a long life and the upper protection film 107 forming the portion 112*a* to be blown is formed to be thin and has a thickness of 10 to 100 nm.

Further, the upper protection film 107 is inserted into a through hole 110 and electrically connected to the electrode wiring layer 105. The electrode wiring layer 105 extends to an end of the base for the inkjet head and a tip end of the electrode wiring layer 105 forms an external electrode 111 for electrically connecting to the outside.

Figure 6A:
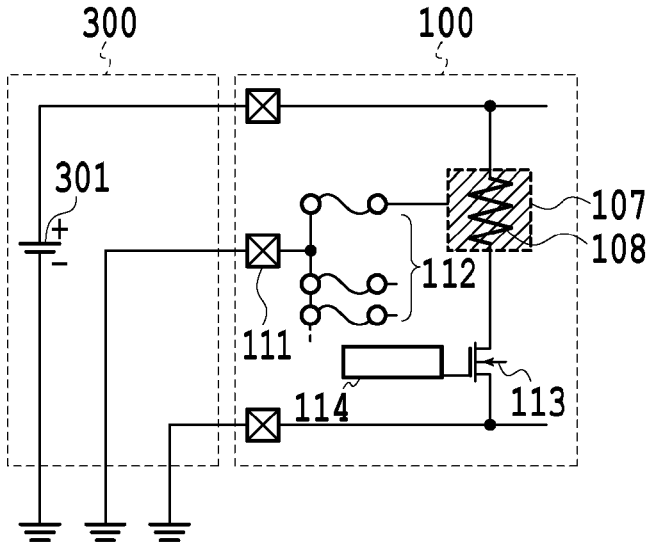
FIGS. 6A to 6C are circuit diagrams for explaining operations of the first embodiment.
Figure 6B:
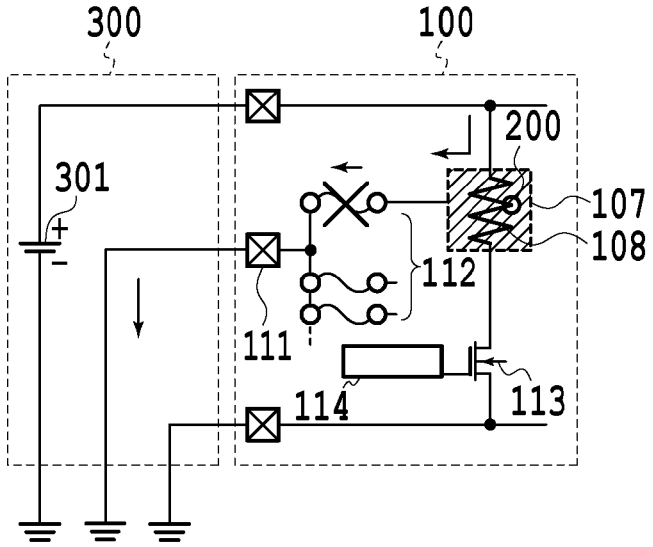
Figure 6C:
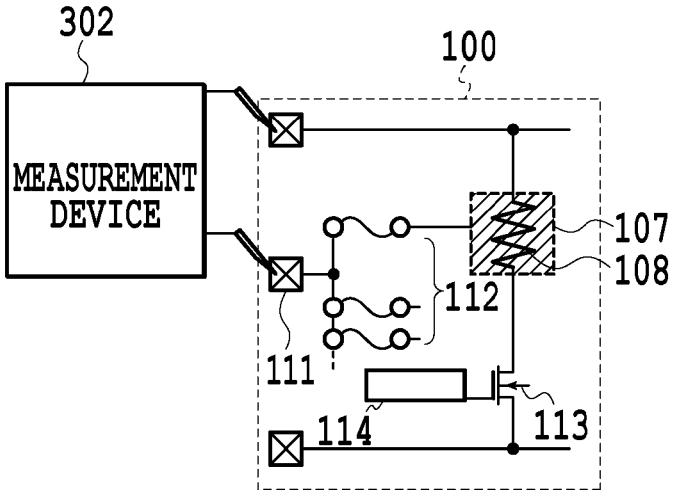

FIGS. 6A to 6C are circuit diagrams for explaining operations of the present embodiment. A selection circuit 114 selects a switching transistor 113 provided for each of the plurality of heating resistors 108, thereby driving the plurality of heating resistors 108. The upper protection film 107 above the heating resistors 108 is connected to the external electrode 111 through the fuse sections 112. The external electrode 111 is grounded through an inkjet printing apparatus 300. A power supply 301 drives the heating resistors 108 and applies a voltage of 20 to 35 V.

In general, polysilicon used for the fuse sections 112 has a melting point of about 1400° C. Further, Ta used for the upper protection film 107 forming the fuse sections 112 of the present embodiment is high-melting-point metal having a melting point of about 4000° C. In order to blow one of the fuse sections 112, it is necessary to melt and remove at least a certain volume of the fuse section 112. Accordingly, large energy is necessary to melt or blow the fuse section 112 formed with Ta. Melting starts at a point of the portion to be blown. The volume of the portion to be melted is substantially proportional to the film thickness and width of the portion to be melted. In a case where the film thickness of the portion 112*a* to be blown of the fuse section is 50 nm and the film thickness of the upper protection film 107 in the heat action sections 108 is 300 nm, the ratio therebetween is 1/6. Accordingly, energy for blowing the fuse section 112 in a case where the features of the present embodiment are used is one-sixth as large as the energy in a case where the thickness of the upper protection film 107 does not change.

Further, a case where a current flows through a member will be discussed below. In a case where the film thickness of the member is reduced to one-sixth, the resistance of the member increases by six times. Energy E is given by the formula $E=I^2R$ where I is a current and R is a resistance. Accordingly, in a case where the film thickness is reduced to one-sixth, the energy decreases to one-sixth and the resistance increases by six times. Therefore, a current required to obtain energy for blowing the fuse section 112 can be reduced to one-sixth. In a case where a current is reduced, the various resistances of other portions through which electricity flows do not have much effect, and energy concentrates on the fuse, thereby improving the sensitivity of the fuse. Even if Ta which is high-melting-point metal is used as in the present embodiment, the fuse section 112 having higher blowing sensitivity can be formed by reducing the thickness of the fuse section to reduce a current.

Further, at the time of blowing, it is necessary to spread a melted material in ink as far as possible and to remove a material which is melted when a current flows through the fuse section 112, from its original position. On this occasion, in a case where a high-melting-point film exists on or above the fuse section 112, even if a material forming the fuse section 112 is melted, the material remains in the fuse section 112 and it is difficult to sever the fuse section 112. In the present embodiment, a high-melting-point member does not exist between the upper protection film 107 and a region in which ink is stored, and accordingly, the fuse section 112 can be severed without fail.

With reference to FIG. 6B, explanation will be made below on a case where the heating resistor 108 is damaged, the protection layer 106 is ruptured, and the heating resistor layer 104 and the upper protection film 107 are partially melted to directly contact each other, whereby a short circuit 200 occurs.

A voltage is continuously applied to the heating resistor 108, and in a case where the short circuit 200 occurs, the voltage is also applied to the upper protection film 107 to cause an electrochemical reaction and start anodization. In a case where anodization proceeds, oxidized Ta dissolves in ink to shorten a life.

The portion in which the short circuit 200 occurs has a low resistance, and the common section of the upper protection film 107 is grounded via the external electrode 111. Accordingly, a large current from the heating resistor 108 flows through the external electrode 111 via the fuse section 112. The power supply 301 applies a voltage of 20 to 30 V and a current flows which is on the order of milliampere and which is large enough to cause the fuse section 112 to generate heat and blow. In a case where such a large current flows, the fuse section 112 is blown and a section of the upper protection film 107 above the damaged heating resistor 108 is electrically separated from sections of the upper protection film 107 above the other heating resistors 108. It takes at most several tens of microseconds to blow the fuse section 112. This is sufficiently shorter than a time which it takes until there occurs an electrochemical reaction in the upper protection film 107, and the portions of the upper protection film 107 above the other heating resistors 108 are not affected. Accordingly, the fuse sections 112 of the present invention play a large role in lengthening the life of the inkjet printing substrate.

The upper protection film 107 is anodized also in a case where the protection layer 106 which insulates the electrode wiring layer 105 is connected via a pinhole or the like at the time of manufacturing. Accordingly, at the time of manufacturing, it is necessary to check whether or not the insulation property is ensured. It is optimum to perform the check after the upper protection film 107 is formed and the external electrode 111 for applying electricity is formed.

With reference to FIG. 6C, checking is performed by setting up a needle (probe pin) of a prober apparatus at the external electrode 111. The probe pin is connected to a measurement device 302. The measurement device 302 has a digital or analog measurement function used for various tests for checking whether the heating resistors 108 and the switching transistors 113 function normally and the like. Measurement is made of a current passed by applying a voltage between the upper protection film 107 and the heating resistors 108 or between the upper protection film 107 and the electrode wiring layer 105 which is equal to or higher than a voltage to be actually applied. On this occasion, in a case where the upper limit of the current is set at 1 mA or less, checking can be performed without blowing any of the fuse sections 112 and without causing any problems.

FIGS. 7A to 7G are cross-sectional views schematically showing a method for manufacturing the substrate for the inkjet head of the present embodiment. Further, FIGS. 8A to 8F are plan views schematically showing the substrate for the inkjet head shown in FIGS. 7A to 7G.

The following manufacturing method is performed for the base 101 made of Si. A driving circuit having semiconductor elements such as the switching transistors 113 for selectively driving the heating resistors 108 may be incorporated into the base 101 beforehand. For sake of simplification of explanation, the attached drawings show the base 101 made of Si.

First, the base 101 is subjected to the thermal oxidation method, the sputtering method, the CVD method, or the like to form the heat accumulating layer 102 made of a $SiO_2$ thermally-oxidized film as a lower layer below the heating resistor layer 104. Incidentally, regarding the base into which the driving circuit is incorporated beforehand, the heat accumulating layer can be formed during a process for manufacturing the driving circuit.

Next, the heating resistor layer 104 of TaSiN or the like is formed on the heat accumulating layer 102 by reaction sputtering so that the heating resistor layer 104 has a thickness of about 50 nm. Further, an Al layer which is the electrode wiring layer 105 is formed by sputtering so that the electrode wiring layer 105 has a thickness of about 300 nm. Dry etching is simultaneously performed on the heating resistor layer 104 and the electrode wiring layer 105 by the photolithography method to obtain a cross-sectional shape shown in FIG. 7A and a planar shape shown in FIG. 8A. Incidentally, in the present embodiment, the reactive ion etching (RIE) method is used as dry etching.

Figure 7A:
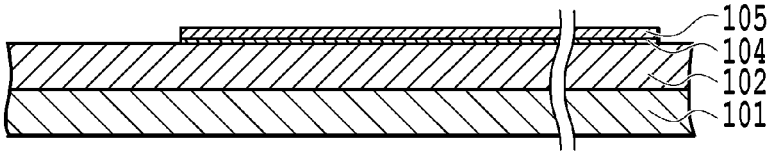
FIGS. 7A to 7G are cross-sectional views illustrating a method for manufacturing the substrate for the inkjet head of the first embodiment.
Figure 7B:
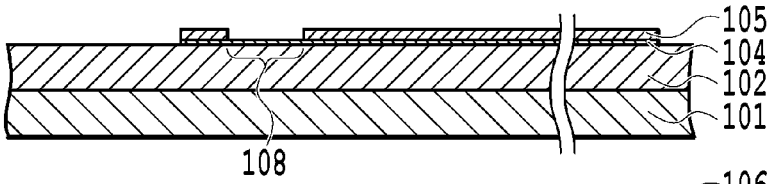
Figure 8A:
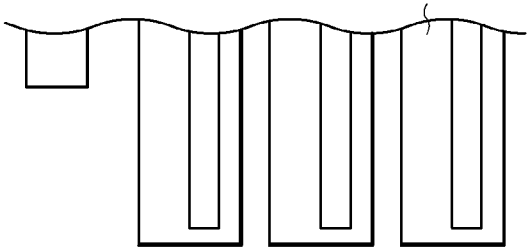
FIGS. 8A to 8F are plan views schematically showing the substrate for the inkjet head shown in FIG. 7.
Figure 8B:
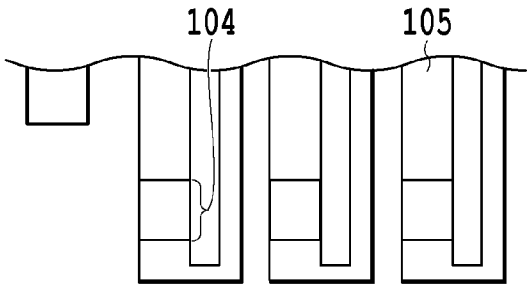

Next, in order to form the heating resistors 108, wet etching is performed by using the photolithography method again to partially remove the electrode wiring layer 105 made of Al and expose corresponding portions of the heating resistor layer 104 as shown in FIGS. 7B and 8B. Incidentally, in order to achieve the excellent coverage property of the protection layer 106 at wiring ends, it is desirable to perform publicly-known wet etching for obtaining an appropriate tapered shape at the wiring ends.

Figure 7C:
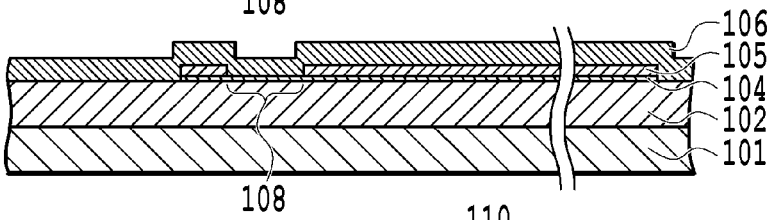
Figure 8C:
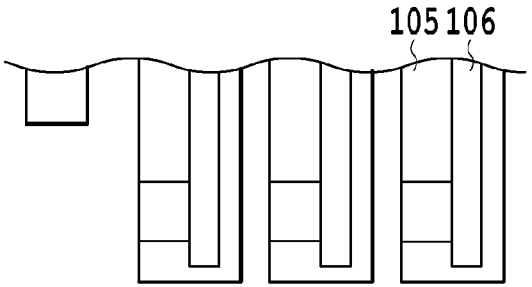

Thereafter, a SiN film as the protection layer 106 is formed to have a thickness of about 350 nm by the plasma CVD method as shown in FIGS. 7C and 8C.

Figure 7D:
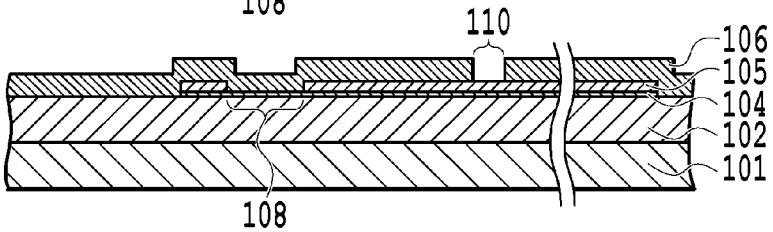
Figure 7E:
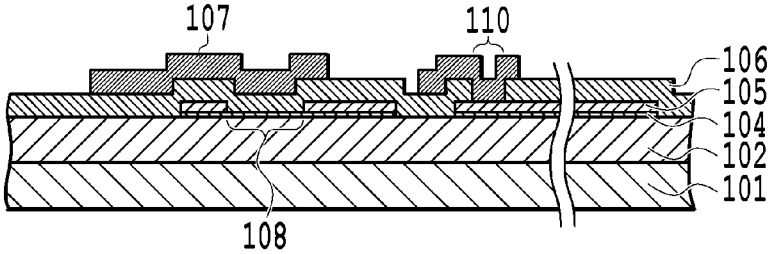
Figure 8D:
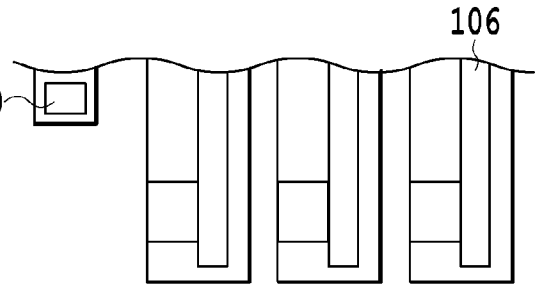
Figure 8E:
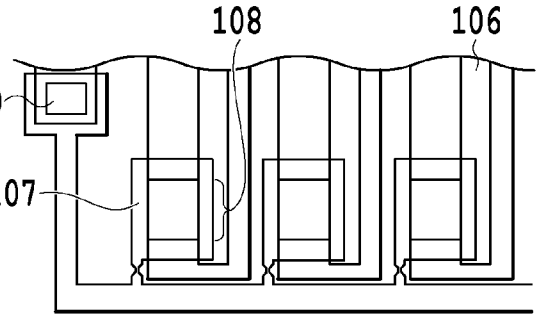

Next, as shown in FIGS. 7D and 8D, dry etching is performed by the photolithography method to form the through hole 110 which enables the upper protection film 107 and the electrode wiring layer 105 to be electrically in contact with each other. This dry etching partially removes the SiN film and exposes a corresponding portion of the electrode wiring layer 105.

Figure 7F:
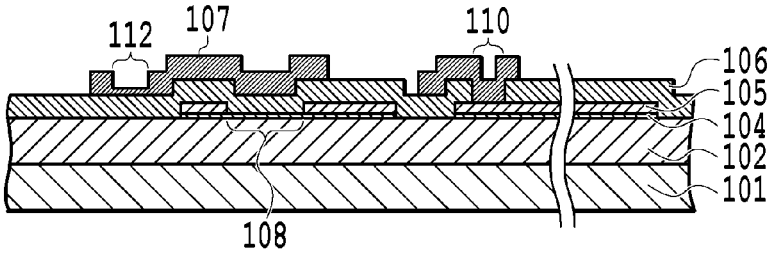
Figure 8F:
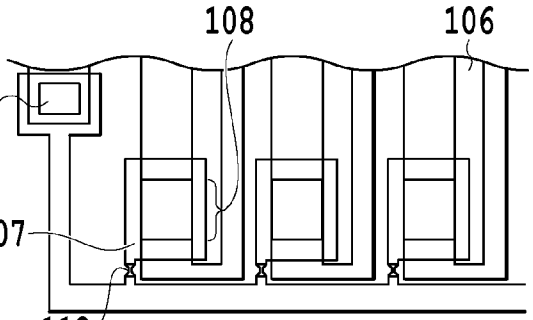

Next, a Ta layer as the upper protection film 107 is formed on the protection layer 106 by sputtering so that the upper protection film 107 has a thickness of about 300 nm. Next, dry etching is performed by the photolithography method to partially remove the upper protection film 107 and obtain a shape shown in FIGS. 7E and 8E. Next, dry etching is performed only on the fuse sections 112 of the upper protection film 107 by the photolithography method. On this occasion, etching is not performed on all the upper protection film 107, and is stopped halfway so that the fuse sections 112 have a thickness of about 50 nm. In this manner, a shape shown in FIGS. 7F and 8F is formed.

Figure 7G:
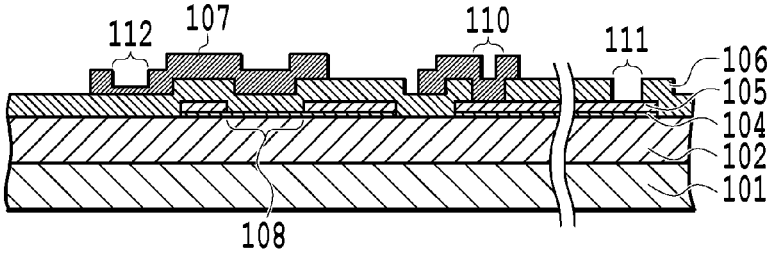

Next, in order to form the external electrode 111, as shown in FIG. 7G, dry etching is performed by the photolithography method to partially remove the protection layer 106 and partially expose a corresponding portion of the electrode wiring layer 105.

In the present embodiment, as shown in FIG. 5B, Ta formed as a layer is half etched to thin the portions 112*a* to be blown of the fuse sections. The portions of the upper protection film 107 above the heating resistors 108 have a thickness of 300 nm which is large enough to achieve a long life. However, the portions 112*a* to be blown of the fuse sections have a thickness of 50 nm so that the portions 112*a* to be blown have blowability which is necessary in a case where the power supply 301 applies a voltage of 24 V and the short circuit 200 occurs.

In this regard, only the portions 112*a* to be blown of the fuse sections may be thin, or the entire fuse sections 112 may be thin. Since it is necessary to efficiently pass a current through sections of the upper protection film 107 above the wiring, the sections of the upper protection film 107 above the wiring preferably have the same thickness as the upper protection film 107 in the heat action section 108, that is, preferably have a thickness of 300 nm in this embodiment.

Further, in the present embodiment, as shown in FIG. 4B, the fuse sections 112 are provided in the liquid chambers so that the fuse sections 112 contact ink. Accordingly, a material forming the blown fuse section 112 spreads far in the ink, and the fuse section 112 can be severed without fail.

Second Embodiment

FIG. 9A is a plan view schematically showing a fuse section 112 of the present embodiment, and FIG. 9B is a cross-sectional view of a substrate taken along line IXB-IXB of FIG. 9A. FIGS. 9C to 9F are explanatory views schematically showing a method for manufacturing an inkjet head of the present embodiment.

Steps performed to reach a state shown in FIG. 9C are identical to those of the above embodiment. Next, a Ta layer as an upper protection film 107*a* is formed on a protection layer 106 by sputtering so that the upper protection film 107*a* has a thickness of about 250 nm.

Next, dry etching is performed by the photolithography method to partially remove the upper protection film 107*a* including portions 112*a* to be blown of the fuse sections so that a shape shown in FIG. 9D is formed. Next, a Ta layer as an upper protection film 107*b* is formed on the upper protection film 107*a* by sputtering so that the upper protection film 107*b* has a thickness of about 50 nm. Then, dry etching is performed by the photolithography method to partially remove the upper protection film 107*b* so that a shape shown in FIG. 9E is formed. Subsequent steps are identical to those of the first embodiment as shown in FIG. 9F. On this occasion, the upper protection film 107*b* protrudes outward from the upper protection film 107*a* as shown in FIG. 9A except for the portions 112*a* to be blown of the fuse sections. In this case, the shape of the portions 112*a* to be blown of the fuse sections are determined based on only a condition for sputtering, and it is easy to enhance the precision of the shape of the portions 112*a* to be blown of the fuse sections.

Further, in a similar structure, the upper protection film 107*a* may be formed to have a thickness of about 50 nm and the upper protection film 107*b* may be formed to have a thickness of about 250 nm. In this case, the portions 112*a* to be blown of the fuse sections are formed of only the upper protection film 107*a*, and their shapes are identical to those of the first embodiment.

Third Embodiment

FIG. 10A is a schematic view showing a fuse section of the present embodiment. FIG. 10B is a cross-sectional view of a substrate taken along line XB-XB of FIG. 10A. FIGS. 10C to 10F are schematic views illustrating a method for manufacturing an inkjet head of the present embodiment. In the present embodiment, an upper protection film 107 is formed of two layers, that is, an upper protection film 107*c* having a thickness of 50 nm and an upper protection film 107*d* having a thickness of 250 nm. The upper protection film 107*c* and the upper protection film 107*d* are formed in substantially the same pattern. Portions 112*a* to be blown of the fuse sections are formed by removing the upper protection film 107*d* and formed of only the upper protection film 107*c*.

The upper protection film 107*c* is formed of Ta, and the upper protection film 107*d* is formed of a platinum group element (Ir in this case).

In a case where a short circuit 200 occurs, since a voltage is continuously applied to an electrode wiring layer 105, a voltage is applied to the upper protection film 107*c*. On this occasion, Ir and Ru cause an electrochemical reaction, but are not anodized to form an oxidized film unlike Ta. Instead, Ir and Ru themselves are eluted. It takes about one second until an electrochemical reaction actually occurs and elution starts.

It takes at most several tens of microseconds to blow the fuse section. This is sufficiently shorter than a time which it takes until there occurs an electrochemical reaction in which the upper protection film 107 is eluted, and accordingly, sections of the upper protection film 107 except for above the heating resistors 108 are not eluted or affected.

FIG. 10C is identical to FIG. 7D. Steps performed to reach a state shown in FIG. 10C are identical to those of the first embodiment.

Next, a Ta layer as the upper protection film 107*c* is formed on a protection layer 106 by sputtering so that the upper protection film 107*c* has a thickness of about 50 nm. Further, an Ir layer as the upper protection film 107*d* is continuously formed by sputtering so that the upper protection film 107*d* has a thickness of about 250 nm. Next, dry etching is performed by the photolithography method to partially remove the upper protection film 107*d* including the portion 112*a* to be blown of the fuse section so that a shape shown in FIG. 10D is formed. On this occasion, etching is stopped without fail by the upper protection film 107*c*.

Then dry etching is performed by the photolithography method to partially remove the upper protection film 107*c* so that a shape shown in FIG. 10E is formed. Subsequent steps are identical to those of the first embodiment shown in FIG. 7G. In this regard, as shown in FIG. 10A, the upper protection film 107*d* is disposed within the upper protection film 107*c* except for the portions 112*a* to be blown of the fuse sections.

It is known that Ir does not adhere tightly to SiN forming the protection layer 106. Ta forming the upper protection film 107*c* has the function of a layer for improving adhesiveness. Further, Ir is a platinum group element and difficult to etch, and in general, a more physical method is used to form. In this case, there is a possibility that SiN forming a lower layer is also etched at a high speed, and that the function of the protection layer 106 is damaged. From this viewpoint, it is effective to provide the upper protection film 107*c* which is the Ta layer between the upper protection film 107*d* which is the Ir layer and the protection layer 106 made of SiN as in the present embodiment.

Incidentally, in the present embodiment, the upper protection film 107*c* formed of Ta is provided between the upper protection film 107*d* and the protection layer 106. However, the present invention is not limited to this. The upper protection film 107*c* formed of Ni may be provided between the upper protection film 107*d* and the protection layer 106. In a case where the upper protection film 107*c* is formed of Ni, the melting point of Ni is about 1500° C. and lower than the melting point of Ir forming the upper protection film 107*d* which is about 2500° C. Further, the thermal conductivity of Ni is about 60% of the thermal conductivity of Ir. Since the thermal conductivity of Ni is relatively low, heat generated in the portion 112*a* to be blown of the fuse section formed of Ni is not likely to be transferred to another portion. Accordingly, heat generated in the portion 112*a* to be blown of the fuse section is not transferred much, and it is possible to reduce, to a low level, heat transferred to the periphery of the portion 112*a* to be blown of the fuse section. Since the thermal conductivity of Ni is 60% of the thermal conductivity of Ir, the amount of heat transferred to the periphery of the portion 112*a* to be blown of the fuse section is about 40% of that in a case where the fuse section is formed of Ir. Therefore, since it is possible to restrain heat generated in the fuse section 112 from being transferred to the periphery of the fuse section 112, the periphery of the fuse section 112 can be restrained from being affected by the heat generated in the fuse section 112. Further, heat generated in the fuse section 112 is not transferred to the periphery of the fuse section 112, and is efficiently used to blow the portion 112*a* to be blown of the fuse section. Accordingly, the portion 112*a* to be blown of the fuse section can be blown efficiently.

Further, the portions 112*a* to be blown of the fuse sections formed of Ni have high corrosion resistance, and in particular, have high corrosion resistance to an alkaline solution used for ink. Accordingly, even in a case where the upper protection film 107*c* is disposed in a position where the upper protection film 107*c* is directly exposed to ink, the upper protection film 107*c* functions well as the portions 112*a* to be blown of the fuse sections.

Fourth Embodiment

FIG. 11A is a plan view showing a fuse section of the present embodiment, and FIG. 11B is a cross-sectional view of a substrate taken along line XIB-XIB of FIG. 11A. FIGS. 11C to 11F are schematic views illustrating a method for manufacturing an inkjet head of the present embodiment. In the present embodiment, an upper protection film 107 is formed of three layers, that is, an upper protection film 107*e* having a thickness of 50 nm, an upper protection film 107*f* having a thickness of 200 nm, and an upper protection film 107*g* having a thickness of 100 nm. The upper protection film 107*e*, the upper protection film 107*f*, and the upper protection film 107*g* are formed in substantially the same pattern, but in portions 112*a* to be blown of the fuse sections, the upper protection film 107*e* and the upper protection film 107*f* are removed, and the portions 112*a* to be blown of the fuse sections are formed of only the upper protection film 107*g*.

FIGS. 11C to 11E illustrate a manufacturing method. A step illustrated in FIG. 11C is identical to the step of the first embodiment explained with reference to FIG. 7D.

Next, a Ta layer as the upper protection film 107*e* is formed on a protection layer 106 by sputtering so that the upper protection film 107*e* has a thickness of about 50 nm. Further, an Ir layer as the upper protection film 107*f* is continuously formed by sputtering so that the upper protection film 107*f* has a thickness of 200 nm. Next, as shown in FIG. 11D, dry etching is performed by the photolithography method to remove a section including the portion 112*a* to be blown of the fuse section. At the same time, the upper protection film 107*e* is also etched.

Next, a Ta layer as the upper protection film 107*g* is formed by sputtering so that the upper protection film 107*g* has a thickness of about 50 nm. As shown in FIG. 11E, dry etching is performed by the photolithography method to partially remove the upper protection film 107*g*. Subsequent steps are identical to those of the first embodiment explained with reference to FIG. 7G. On this occasion, as shown in FIG. 11A, the upper protection film 107*e* and the upper protection film 107*f* are disposed within the upper protection film 107*g* except for the portion 112*a* to be blown of the fuse section. In this case, the shape of the portions 112*a* to be blown of the fuse sections are determined based on only a condition for sputtering, and it is easy to enhance the precision of the shape of the portions 112*a* to be blown of the fuse sections.

The upper protection film 107*e* and the upper protection film 107*g* are formed of Ta, and the upper protection film 107*d* therebetween is formed of a platinum group element (Ir in this case). The upper protection film 107*e* also has the function of a layer for improving adhesiveness as in the third embodiment. After etching reaches the upper protection film 107*e*, it is preferable to perform etching under a condition suitable for Ta because the protection layer 106 is not damaged.

Fifth Embodiment

Figure 12A:
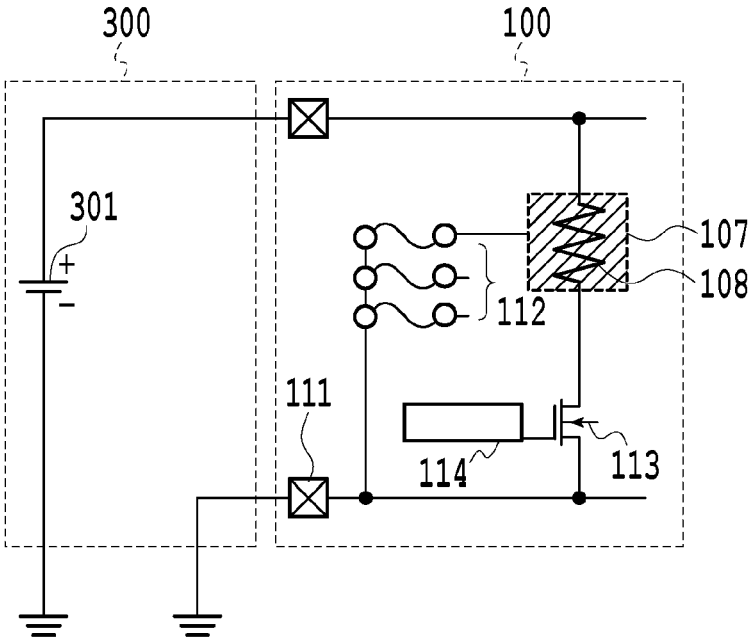
FIGS. 12A and 12B are circuit diagrams for explaining operations of a fifth embodiment.
Figure 12B:
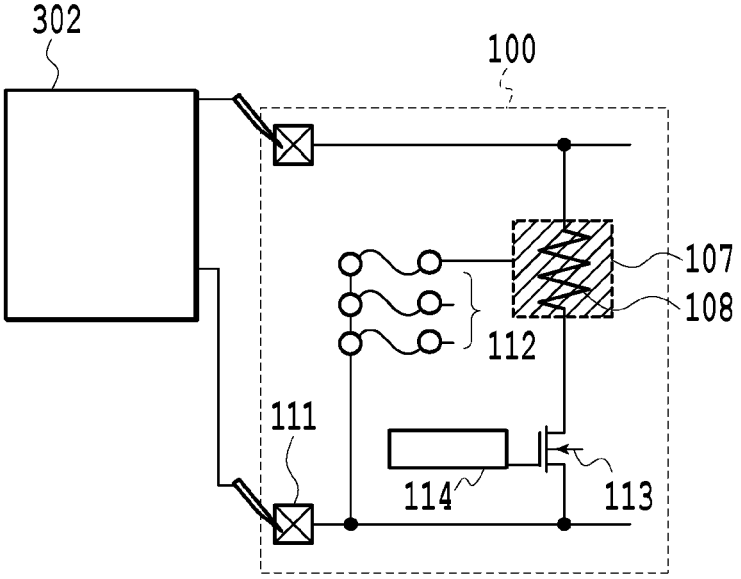

FIGS. 12A and 12B are circuit diagrams for explaining operations of the present embodiment. In the present embodiment, in a substrate 100 for an inkjet head, a common external electrode is used as both an external electrode 111 for fuse sections 112 and an external electrode led out from ground-side terminals of switching transistors 113. FIG. 12B is a circuit diagram in a case where the insulation property of a protection layer 106 is checked. In a case where the switching transistors 113 are configured to be closed without fail when checking the insulation property of the protection layer 106, checking can be performed by applying a voltage across an electrode wiring layer 105 above a terminal on the side of heating resistors 108 or between the heating resistors 108 and an upper protection film 107. It is desirable to check beforehand whether the switching transistors 113 operate normally. This embodiment can also be applied to the first to fourth embodiments.

Sixth Embodiment

FIG. 13A is a plan view of a fuse section 112 of an inkjet head of a sixth embodiment. FIG. 13B is a cross-sectional view taken along line XIIIB-XIIIB of FIG. 13A.

In the inkjet head of the third embodiment, the upper protection film 107*c* is formed between the upper protection film 107*d* and the protection layer 106 to cover the entire protection layer 106. On the other hand, in the sixth embodiment, an upper protection film 107*c* is formed only in the periphery of the fuse sections 112. Further, the inkjet head has the feature that the upper protection film 107*c* is not formed at positions corresponding to heating resistors 108.

Accordingly, in the present embodiment, not the upper protection film 107*c* but only an upper protection film 107*d* is formed above (on the front side of) the heating resistors 108. Therefore, in a case where the heating resistors 108 generate heat, the heat can be efficiently transferred to ink.

The upper protection film 107*c* is formed to have a thickness of 200 nm. Further, the upper protection film 107*d* is formed to have a thickness of 250 nm.

FIGS. 13C to 13F are cross-sectional views of a substrate for the inkjet head at each step for explaining a method for manufacturing the inkjet head of the sixth embodiment.

At a stage shown in FIG. 13C, the substrate for the inkjet head is identical to the substrate of the first embodiment shown in FIG. 7D. Accordingly, up to the stage shown in FIG. 13C, the manufacturing method is identical to the method for manufacturing the substrate for the inkjet head of the first embodiment.

Next, the upper protection film 107*c* is formed on a protection layer 106. The upper protection film 107*c* is formed of a Ni layer, and is formed by sputtering to have a thickness of about 200 nm.

Next, as shown in FIG. 13D, dry etching is performed by the photolithography method to partially remove the upper protection film 107*c*. The upper protection film 107*c* is removed so as to remove portions of the upper protection film 107*c* corresponding to the heating resistors 108.

Next, the upper protection film 107*d* is formed on the upper protection film 107*c*. The upper protection film 107*d* formed of Ir is formed by sputtering to have a thickness of about 250 nm. Further, as shown in FIG. 13E, dry etching is performed by the photolithography method to partially remove the upper protection film 107*d*. As shown in FIG. 13A, width-direction outer ends of the upper protection film 107*d* are preferably disposed within width-direction outer ends of the upper protection film 107*c* relative to a width direction except for portions 112*a* to be blown of the fuse sections 112.

After that, the step of forming an external electrode 111 and the step of forming a flow path forming member 120 (FIG. 13F) are performed.

Incidentally, Cr is also preferably used for the upper protection film 107*c*. Further, a material for the upper protection film 107*d* is not limited to Ir, and a metal material such as Ru or Ta may be used.

Seventh Embodiment

Next, an inkjet head of a seventh embodiment will be described.

FIG. 14A is a plan view of a fuse section 112 of an inkjet head of a seventh embodiment. FIG. 14B is a cross-sectional view taken along line XIVB-XIVB of FIG. 14A. FIGS. 14C to 14F are schematic views illustrating a method for manufacturing an inkjet head of the present embodiment.

In the inkjet heads of the third and sixth embodiments, the upper protection film 107*c* is disposed between the protection layer 106 and the upper protection film 107*d*, and the upper protection film 107*c* is formed below the upper protection film 107*d*. On the other hand, the inkjet head of the seventh embodiment is different from the inkjet heads of the third and sixth embodiments in that in the inkjet head of the seventh embodiment, the upper protection film 107*c* is disposed on the upper protection film 107*d*.

The upper protection film 107*d* is formed to have a thickness of about 250 nm, and the upper protection film 107*c* is formed to have a thickness of about 200 nm.

Also in the present embodiment as in the sixth embodiment, portions 112*a* to be blown of the fuse sections 112 are formed of only the upper protection film 107*c*, and not the upper protection film 107*c* but only the upper protection film 107*d* is formed above heating resistors 108.

In the present embodiment, the upper protection film 107*c* is disposed on the upper protection film 107*d* across its width direction to cover the upper protection film 107*d*. Accordingly, width-direction outer ends of the upper protection film 107*d* are disposed within width-direction outer ends of the upper protection film 107*c*. The upper protection film 107*c* is formed of Ni and the upper protection film 107*d* is formed of Ir.

FIGS. 14C to 14F are cross-sectional views of a substrate for the inkjet head at each step for explaining the method for manufacturing the inkjet head of the seventh embodiment.

In a stage shown in FIG. 14C, the substrate for the inkjet head is identical to the substrate of the first embodiment shown in FIG. 7D. Accordingly, up to the stage shown in FIG. 14C, the manufacturing method is identical to the method for manufacturing the substrate for the inkjet head of the first embodiment.

Next, the upper protection film 107*d* is formed on the protection layer 106. The upper protection film 107*d* formed of an Ir layer is formed by sputtering to have a thickness of about 250 nm.

Next, dry etching is performed by the photolithography method to partially remove the upper protection film 107*d* so that a shape shown in FIG. 14D is formed. On this occasion, the upper protection film 107*d* is removed so that the upper protection film 107*d* does not exist at positions corresponding to the fuse sections 112, and as a result, the upper protection film 107*d* is formed in a predetermined shape.

Next, the upper protection film 107*c* is formed on the upper protection film 107*d*. On this occasion, the upper protection film 107*c* formed of the Ni layer is formed by sputtering to have a thickness of about 200 nm.

Then as shown in FIG. 14E, dry etching is performed by the photolithography method to partially remove the upper protection film 107*c*. As a result, portions of the upper protection film 107*c* corresponding to the heating resistors 108 are removed. On this occasion, as shown in FIG. 14A, ends of the upper protection film 107*d* are preferably disposed within the upper protection film 107*c* relative to a width direction except for the portions 112*a* to be blown of the fuse sections 112.

After that, the step of forming an external electrode 111 and the step of forming a flow path forming member 120 (FIG. 14F) are performed.

In the present embodiment, the upper protection film 107*c* is formed on the upper protection film 107*d*. Accordingly, as shown in FIG. 14F, the upper protection film 107*c* is disposed in an area where the substrate 100 and a flow path forming member 120 adhere to each other. Ni forming the upper protection film 107*c* has high adhesiveness with the flow path forming member 120 and high reliability.

Accordingly, adhesiveness between the substrate 100 and the flow path forming member 120 can be improved by positioning the upper protection film 107*c* between the substrate 100 and the flow path forming member 120. Therefore, adhesion between the substrate 100 and the flow path forming member 120 can be enhanced. This can further improve the reliability of the inkjet head.

Further, also in the present embodiment, only the upper protection film 107 is disposed above the heating resistors 108 and in a case where the heating resistors 108 generate heat, the heat can be transmitted to ink efficiently. Further, as in the sixth embodiment, Cr is also preferably used for a material forming the upper protection film 107*c*. Furthermore, a material for the upper protection film 107*d* is not limited to Ir, but the upper protection film 107*d* may be formed with a metal material such as Ru or Ta. Incidentally, Ta has high adhesiveness with the protection layer 106 and is preferably used for a material for the upper protection film 107. Further, it is more preferable to form the upper protection film 107 with two layers consisting of a Ta layer and an Ir layer overlying the Ta layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-285437, filed Dec. 27, 2012 and 2012-285449, filed Dec. 27, 2012, which are hereby incorporated by reference herein in their entirety.

What is claimed is:

1. A substrate for an inkjet head comprising:

a base;

a heating resistor layer disposed on the base and including a plurality of heating resistors which generate heat to eject ink;

a first protection layer disposed to cover the heating resistor layer and having an insulation property; and a second protection layer disposed to contact the first protection layer and having conductivity, wherein the second protection layer includes a plurality of individual sections provided to correspond to the plurality of heating resistors, a common section connecting the plurality of individual sections, and fuse sections connecting the individual sections and the common section, the fuse sections being formed to be thinner than the individual sections.

2. The substrate for the inkjet head according to claim 1, wherein a film thickness of the individual sections of the second protection layer is in the range of 200 to 500 nm, and a film thickness of the fuse sections is in the range of 10 to 100 nm.

3. The substrate for the inkjet head according to claim 1, wherein the second protection layer is formed of a single layer, and the fuse sections are formed to be thin by stopping etching halfway.

4. The substrate for the inkjet head according to claim 1, wherein the second protection layer is formed of a plurality of layers, the individual sections are formed of a plurality of layers, and the fuse sections are formed of one layer.

5. The substrate for the inkjet head according to claim 4, wherein among the plurality of layers forming the second protection layer, a layer on a side of the heating resistors includes Ta and a layer provided to cover the layer on the side of the heating resistors includes Ir, and the fuse sections are formed of the layer including Ta.

6. The substrate for the inkjet head according to claim 1, wherein the second protection layer is connected to an external electrode through the fuse sections.

7. The substrate for the inkjet head according to claim 6, wherein the second protection layer is grounded through the external electrode.

8. An inkjet printing apparatus for printing onto a print medium with an inkjet head comprising the substrate for the inkjet head according to claim 6 and a flow path forming member attached to a side of the substrate on which the second protection layer is disposed and having a plurality of ejection ports formed therein, wherein the external electrode is grounded through the inkjet printing apparatus.

9. The substrate for the inkjet head according to claim 1, wherein the second protection layer includes Ta.

10. An inkjet head comprising:

the substrate for the inkjet head according to claim 1; and a flow path forming member attached to a side of the substrate on which the second protection layer is disposed and having a plurality of ejection ports formed therein.

* * * * *